US006024809A

United States Patent [19]

Ono et al.

[11] Patent Number: 6,024,809

[45] **Date of Patent: *Feb. 15, 2000**

[54] FE-NI ALLOY MATERIALS FOR ELECTRONIC PARTS

[75] Inventors: Toshiyuki Ono; Kazuhiko Fukamachi, both of Samukawa-machi, Japan

[73] Assignee: Nippon Mining & Metals Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/971,942

[22] Filed: Nov. 17, 1997

[30] Foreign Application Priority Data

Mar. 24, 1997 [JP] Japan ..... 9-087319

[51] Int. Cl.[7] ..... C22C 38/08

[52] U.S. Cl. ..... 148/625; 148/628; 148/631; 148/633

[58] Field of Search ..... 420/94, 459, 581; 148/625, 628, 631, 633

[56] References Cited

U.S. PATENT DOCUMENTS 4,816,216 3/1989 Chao et al. ..... 420/94

FOREIGN PATENT DOCUMENTS 4224630 8/1992 Japan .
6220588 8/1994 Japan .
7179998 7/1995 Japan .

*Primary Examiner*—Sikyin Ip
*Attorney, Agent, or Firm*—Seidel, Gonda, Lavorgna & Monaco, PC

[57] ABSTRACT

Fe—Ni alloy with improved etch factors for electronic parts are provided which are characterized by the composition consisting of, all by weight, 30–55% Ni, 0.8% or less Mn, 0.0030–0.0100% N, or 0.02% less Al, and the balance Fe and unavoidable impurities, preferably with 0.01% or less C, 0.003% or less Si, 0.005%, or less S, 0.005% or less P, and 0.0100% or less O. There is provided Fe—Ni alloy materials for electronic parts which have high etch factors and produce favorably etched surfaces without blister generation, by restricting the N and Al contents within specified ranges and preferably limiting C, Si, P, S, and O contents below specified levels.

2 Claims, 2 Drawing Sheets d: depth
SE: side etched amount $$EF = \frac{d}{SE}$$

r: resist opening dia.
R: etched opening dia.

$$SE = \frac{R-r}{2}$$

FE-NI ALLOY MATERIALS FOR ELECTRONIC PARTS

BACKGROUND OF THE INVENTION

This invention relates to iron-nickel alloy materials for use in forming electronic parts such as shadow masks and lead frames with fine etching. More particularly, this invention relates to Fe—Ni alloy materials to be used for electronic parts, with their perforation etchability enhanced through the control of the nitrogen content in the Fe—Ni alloy material.

In recent years, there has been a steady increase in the degree of integration in the field of microprocessors and other integrated circuit parts. Among lead frames, for instance, multi-pin type parts having 200 or more pins are coming into predominant use. Those multi-pin type parts are made chiefly of a Fe—Ni alloy known as "42 Alloy (Fe-42% Ni alloy)" because of its strength.

In the manufacture of shadow masks for color picture tubes too, another Fe—Ni alloy called "36 Alloy (Fe-36% Ni alloy)" whose low coefficient of thermal expansion is favorable for color purity is in use.

In general, multi-pin lead frames and high-precision shadow masks for which dimensional accuracy is a prime consideration are made using photoetching. For finer pitches of grooves, a more finely etchable material, especially a material having a greater ratio of the etching rate in the thickness direction to the etching rate in the side direction, known as the "etch factor" is required. Fe—Ni alloys have low etch factors compared to copper alloys and aluminum-killed steels. This has been an obstacle in the way toward finer-pitching of Fe—Ni alloys.

For the purposes of the invention, the etch factor (EF) is expressed, in FIG. 1 that schematically depicts an etched state, as $$EF=d/SE$$

where d is the depth of etching and SE is the side etched amount.

The side etched amount (SE) means the amount etched to excess beyond the edge of an opening made in a resist layer and is expressed as $SE=(R-r)/2$ where R is the diameter of the opening actually formed by etching and r is the diameter of the exposed area or opening in the resist layer.

Some proposals have hitherto been made to improve the etchability of Fe—Ni alloys by decreasing the proportions of nonmetallic inclusions and trace impurities in the alloys. However, none of the proposed methods have been fully satisfactory in improving their etching properties.

Meanwhile, another approach has been proposed which comprises intensively working a Fe—Ni alloy material to increase the texture concentration of the {100} planes in the worked area and thereby improve the etchability. This method again has drawbacks in that it can cause roughening or streaking of the etched surface and, moreover, increases the anisotropy of the etch factor.

The present invention aims at providing Fe—Ni alloy materials that lend themselves excellently to fabrication as by etching and permit the manufacture of such electronic parts as multi-pin lead frames and high-precision shadow masks by photoetching with good precision, without the drawbacks of the prior art.

BRIEF SUMMARY OF THE INVENTION

The present inventors have made extensive investigations with a view to achieving this aim and have now found the following.

Fe—Ni alloys for electronic parts usually contain nitrogen; for example, the Fe—Ni alloys for shadow masks, typified by 36 Alloy, contain from 0.001 to 0.003 wt % N. It has just been found that the larger the N content the higher the etch factor.

In particular, the tendency of the etch factor and the conditions of etched wall surfaces upon etching of Fe-30–55 wt % Ni alloys (hereafter the compositional proportions to be given in percent are all by weight) with increased contents of N, C, and Si as impurities (namely, elements other than Fe, Ni, and Mn) were investigated. The results showed, as FIG. 2 indicates, that the etch factor increases in direct proportion to the N content and in inverse proportion to either the C or Si content. It is worthy of special mention that the improvement in the etch factor attained by the addition of one digit to the N content has been found to be about twice that attained with one digit off the C and Si contents. It has also been found that an increase in the N content to a certain range causes nothing abnormal on the etched wall surface and also that an Al content below 0.02% ensures a sound condition of the etched wall surface.

In brief, the presence of N has now been confirmed as an element which increases the etch factor as its content is increased, without producing any abnormality such as traces of inclusions on the etched surfaces of Fe—Ni alloys.

Similarly, an increase in S content raises the etch factor but the etched surface has many marks indicating the release of sulfides. From this, an S-rich Fe—Ni alloy was judged unsuitable as a material to be etched.

This invention is predicated upon these findings and is characterized by "an Fe—Ni alloy material for electronic parts consisting of, all by weight, from 30 to 55% Ni, 0.8% or less Mn, from 0.0030 to 0.0100% N, 0.02% or less Al, and the balance Fe and unavoidable impurities."

The invention further improves the etch factor by restricting preferably the C, Si, P, S, and O contents below specified levels, and is characterized by "an Fe—Ni alloy material for electronic parts consisting of, all by weight, from 30 to 55% Ni, 0.8% or less Mn, from 0.0030 to 0.0100% N, 0.02% or less Al, 0.01% or less C, 0.03% or less Si, 0.005% or less S, 0.005% or less P, 0.0100% or less O, and the balance Fe and unavoidable impurities."

DETAILED EXPLANATION OF THE INVENTION

Figure 1:
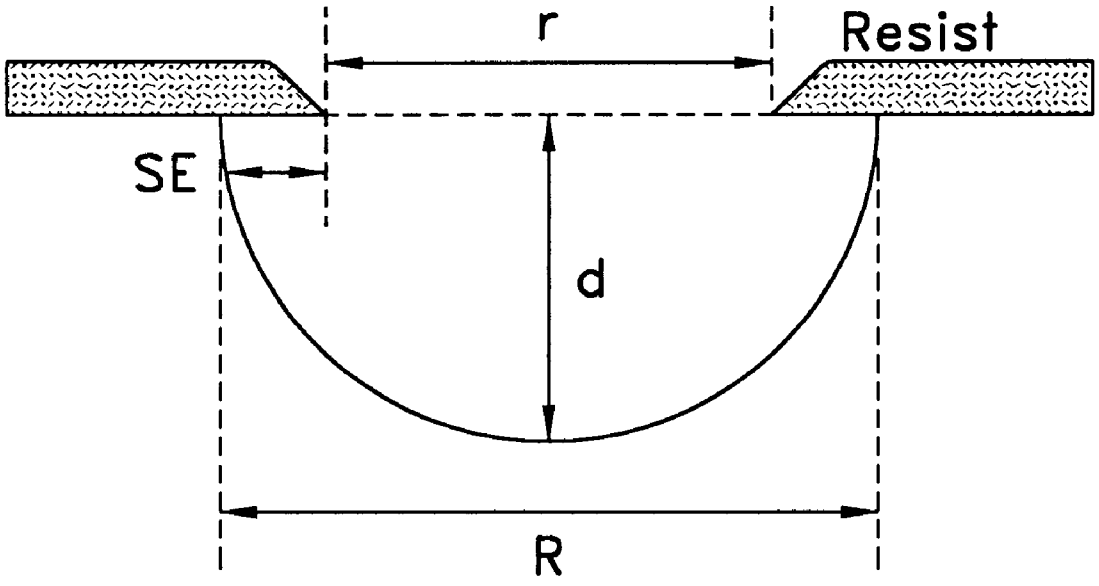
FIG. 1 is a schematic view explaining the etch factor (EF).
Figure 2:
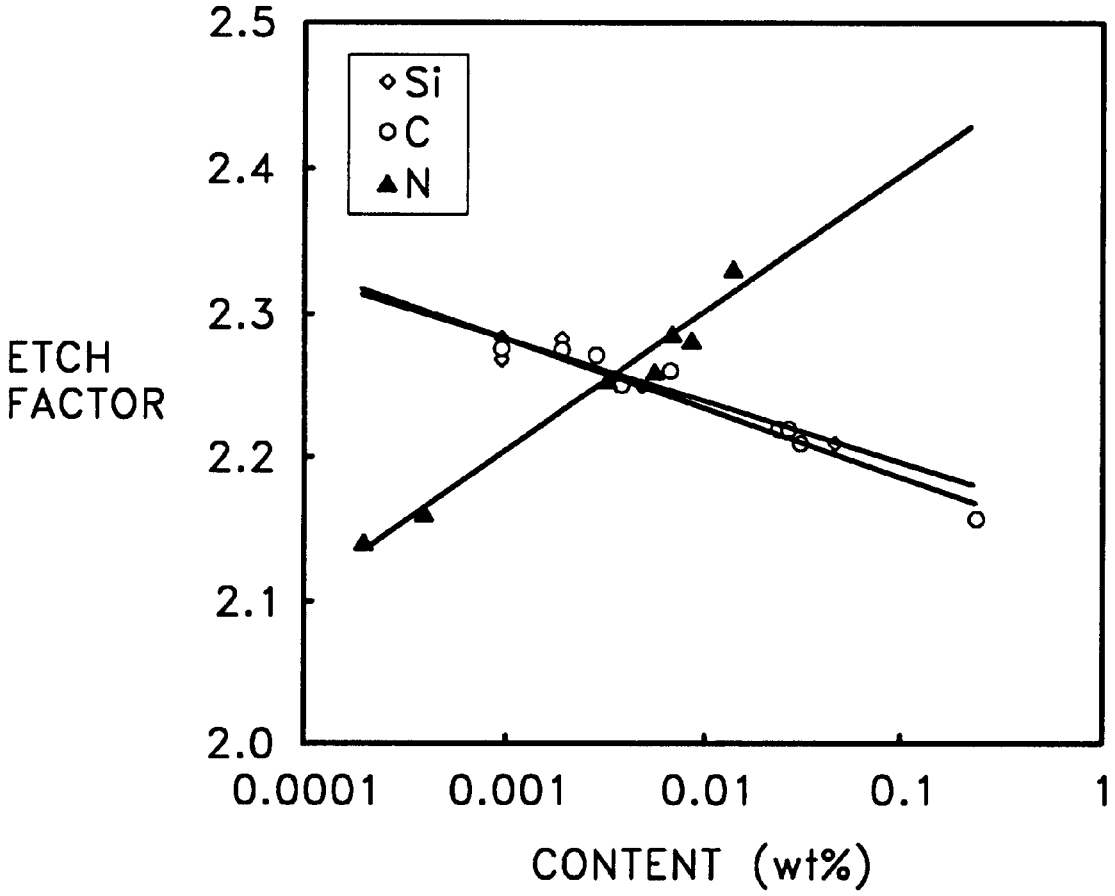
FIG. 2 is a graph showing the relations between N, Si, and C contents in Fe-36% Ni alloy specimens and the etch factors of the specimens wherein the etch factor was determined at the point when the side etched amount reached 15 $\mu$m during spray etching of 80 $\mu$m-diameter resist openings on the specimen with a 48 Be etchant at 65° C. and at a pressure of 2.6 kg/cm$^2$.

As stated above, this invention resides in essence in the enhancement of the etchability of a Fe—Ni alloy material for electronic parts through the control of its N content. The reasons for which the numerical ranges of the compositional elements of the material according to this invention are restricted as specified above will now be explained.

A) N Content in the Material

The larger the N content the better, because it substantially improves the etch factor. However, an N content beyond 0.0100% produces so many pores in the ingot that the pores become defects known as blisters in the material upon annealing after rolling to a thin sheet. The upper limit of the N content, therefore, is set to be 0.0100%. Since less than 0.0030% N does not achieve a satisfactory improvement in the etch factor, the lower limit is fixed to be 0.0030%.

B) Al Content in the Material

Al is used in deoxidizing a Fe—Ni alloy material. With an alloy containing from 0.0030 to 0.0100% N, an Al content of more than 0.02% forms nitride inclusions which deteriorate the etchability of the alloy. Therefore, the upper limit of 0.02% is specified.

C) Mn Content in the Material

The smaller the Mn content the more noticeably the etch factor is improved. However, it is an indispensable element to prevent S from hampering the hot workability of the alloy stock, by fixing S in the form of MnS. For this reason an upper limit of 0.8% is given to the Mn content. In order to minimize the Mn content and attain a better etch factor, a proportion of 0.05% or less is preferred.

D) C Content in the Material

Because it deteriorates the etchability of the material, the C content is desired to be as small as possible. However, substantially reducing the content in the alloy manufacture on an industrial scale is difficult for economic reasons. In view of this, the upper limit of 0.01% is chosen.

E) Si Content in the Material

Si also obstructs etching, and the Si content should be as low as possible. However, a large reduction of Si content in industrial-scale operation is economically unwarranted. Hence the upper limit is 0.03%.

F) P Content in the Material

P is another element that hampers etching and is desired to be at a minimum in the material. However, a sharp decrease in the P content in industrial-scale operation involves economic difficulties. Hence the upper limit is 0.005%.

G) O Content in the Material

The O content is desirably as small as possible because it can form oxide inclusions that hamper etching. Marked reduction of O content on an industrial scale, however, is economically difficult. Hence the upper limit is 0.0100%.

H) S Content in the Material

S is an element that increases the etch factor of a Fe—Ni alloy material, but it deteriorates the hot workability of the material and, in the form of sulfide inclusions, can roughen the etched surface. Thus, from the viewpoint of hot workability, the upper limit is set to 0.005%.

The process for producing an Fe—Ni alloy material for electronic parts in accordance with this invention is explained below.

The Fe—Ni alloy material according to this invention is prepared to form a composition including, all by weight, from 30 to 55% Ni, 0.8% or less Mn, from 0.0030 to 0.0100% N, 0.02% or less Al, preferably also controlling to 0.01% or less C, 0.03% or less Si, 0.005% or less S, 0.005% or less P, 0.0100% or less O, and the balance Fe and unavoidable impurities. This composition can be obtained by premixing an Fe—Ni alloy with about 0.8% Mn, melting the mixture, removing S, P, O and/or C according to the necessity to adjust their contents, adjusting the Mn content, and then placing the material in a nitrogen atmosphere immediately before casting so as to adjust the N content. Alternatively, the N content can be adjusted by adding iron or nickel nitride into the melt. Where the melting process makes refining as by vacuum melting difficult, it is possible to use carefully selected raw materials to adjust the components other than N and then adjust the N content by the addition of a nitride or by the replacement of the casting atmosphere with nitrogen.

Following the compositional adjustments, the molten Fe—Ni alloy may be either ingotted or continuously cast.

The ingot thus obtained can be forged or rolled without the danger of hot shortness. Subsequent repetition of annealing and cold rolling produces a material of desired thickness for electronic parts.

Applications sometimes demand the elimination of anisotropy of the etch factor and such demand can be met by controlling the degree of cold rolling.

The final cold rolling may be followed by stress relieving annealing or shape correction.

As explained above, materials for electronic parts with remarkably improved perforation etchability, especially the etch factor, can now be made through the control of the N contents in Fe—Ni alloys. Moreover, reduction in the proportions of the elements that obstruct etching render it possible to obtain more desirable materials for electronic parts.

EXAMPLES

Some examples of the invention will now be explained as contrasted with comparative examples.

Test Specimen Nos. 1 to 7 represent examples that satisfy the requirements of this invention, and Specimen Nos. 8 to 13 represent comparative examples. Specimen Nos. 1 to 4, 8, 10 and 12 are Alloys 36. and Specimen Nos. 5 to 7, 9, 11, and 13 are Alloys 42. Of the comparative examples, Specimen Nos. 8 to 11 have N contents of less than 0.0030% or N contents of more than 0.0100%. Specimen Nos. 12 and 13 have Al contents in excess of 0.02%.

All the specimens were made by vacuum melting from pure iron, pure nickel, and pure manganese as main raw materials, using aluminum for the deoxidation purpose. Complete melting was followed by compositional adjustments. Except for Specimen Nos. 8 and 9, each of the melts was held in the furnace into which nitrogen gas was introduced and kept at an internal pressure of 1 to 300 torrs for 1 to 30 minutes, whereby its N content was adjusted, and was cast at an internal pressure of 0.5 torr to make an ingot. For Specimen Nos. 8 and 9. Ar was introduced into the furnace immediately before casting, and at an internal pressure of 0.5 torr each melt was cast into an ingot. The chemical compositions of the cast ingots are shown in Table 1.

Each ingot was forged, descaled, hot rolled and descaled. Cold rolling and annealing were then repeated until a 0.15 mm-thick alloy strip was formed. After the final annealing, the ingots so obtained were inspected to determine weather or not blister defects occurred. To compare their etch factors, a resist mask having a number of round perforations 80 $\mu$m in diameter was formed on one side of each alloy strip by the well-known photolithographic technique. A 48 Baume solution of ferric chloride in water at 65° C., was sprayed against the mask at a pressure of 2.6 kg/cm$^2$. At the point when the side etched amount as shown in FIG. 1 reached 15 $\mu$m, the etch factor value and the condition of the etched wall surface were determined. The results with the examples of this invention and with the comparative examples are summarized in TABLE 1.

TABLE 1 indicates that Specimen Nos. 1 to 4 of this invention, all of "36 Alloy", having N contents of more than 0.0030% and less than 0.0100%, had higher etch factors than Specimen No. 8 which contained 0.0004% N, showing that the larger the N content the higher the etch factor. The same tendency was observed with Specimen Nos. 5 to 7, all of "42 Alloy" having N contents between 0.0030% and 0.0100%, in contrast with Specimen No.9 which contained 0.0015% N.

Specimen Nos. 10 and 11 generated blisters because their N contents were in excess of 0.0100% N. Specimen Nos. 12 and 13 which contained more than 0.02% Al showed many marks of inclusions on the etched wall surfaces.

Thus, specimens with N contents in the range of 0.0030 to 0.0100% did not generate blisters and attained increased etch factors Furthermore, by restricting the Al contents to 0.02% or less, favorably etched wall surfaces were provided.

As for the etch factors given in TABLE 1, their absolute values changed with the etching conditions used but remained unchanged with respect to the N contents.

As has been described hereinabove, this invention makes it possible to provide Fe—Ni alloy materials for electronic parts which have high etch factors and produce favorably etched surfaces without blister generation, by restricting the N and Al contents within specified ranges and preferably limiting C, Si, P, S, and O contents below specific levels. This invention has very great industrial significance in that it permits the provision of high-quality Fe—Ni alloy materials quite suited for the fabrication of high precision shadow masks, multi-pin lead frames, and other electronic parts that involve etching, without incurring refining costs such as for the reduction of trace impurities.

TABLE 1

| Sample No. | Chemical composition (wt %) C | Si | Mn | P | S | Ni | Al | O | N | Perforation etchability Etch factor | Wall surface condition | Generation of blister |
|---|---|---|---|---|---|---|---|---|---|---|---|---|
| 1 | 0.006 | 0.01 | 0.24 | 0.003 | 0.004 | 36.14 | 0.01 | 0.0025 | 0.0034 | 2.30 | good | no |
| 2 | 0.003 | 0.01 | 0.25 | 0.002 | 0.003 | 35.87 | 0.01 | 0.0030 | 0.0058 | 2.35 | good | no |
| 3 | 0.004 | 0.01 | 0.26 | 0.003 | 0.002 | 35.72 | 0.01 | 0.0035 | 0.0072 | 2.37 | good | no |
| 4 | 0.004 | 0.02 | 0.24 | 0.002 | 0.003 | 36.08 | 0.01 | 0.0043 | 0.0089 | 2.39 | good | no |
| 5 | 0.003 | 0.03 | 0.48 | 0.002 | 0.002 | 42.15 | 0.02 | 0.0021 | 0.0033 | 2.25 | good | no |
| 6 | 0.005 | 0.02 | 0.49 | 0.002 | 0.002 | 41.87 | 0.02 | 0.0024 | 0.0049 | 2.29 | good | no |
| 7 | 0.003 | 0.02 | 0.48 | 0.002 | 0.003 | 42.08 | 0.01 | 0.0042 | 0.0098 | 2.36 | good | no |
| 8 | 0.004 | 0.01 | 0.26 | 0.003 | 0.004 | 36.08 | 0.02 | 0.0018 | 0.0004 | 2.09 | good | no |
| 9 | 0.004 | 0.02 | 0.48 | 0.004 | 0.003 | 42.12 | 0.01 | 0.0019 | 0.0015 | 2.18 | good | no |
| 10 | 0.003 | 0.02 | 0.25 | 0.002 | 0.003 | 35.97 | 0.01 | 0.0042 | 0.0150 | 2.44 | good | yes |
| 11 | 0.005 | 0.03 | 0.47 | 0.003 | 0.003 | 41.89 | 0.02 | 0.0032 | 0.0135 | 2.39 | good | yes |
| 12 | 0.004 | 0.02 | 0.24 | 0.002 | 0.002 | 36.08 | 0.03 | 0.0032 | 0.0035 | 2.30 | many inclusion marks | no |
| 13 | 0.003 | 0.01 | 0.48 | 0.002 | 0.002 | 42.07 | 0.04 | 0.0025 | 0.0032 | 2.26 | many inclusion marks | no |

Nos.1–7: Examples of this invention
Nos. 8–13: Comparative examples

We claim:

1. A method of enhancing the etch factor of a Fe—Ni alloy material for electronic parts, the steps comprising;

providing Fe—Ni alloy material consisting of, all by weight, from 30 to 55% Ni, 0.8% or less Mn, 0.02% or less Al, less than 0.003 or more than 0.0100% N, and the balance Fe and unavoidable impurities;

melting said Fe—Ni alloy material to provide a molten Fe—Ni alloy material;

controlling N content in the final Fe—Ni alloy material in the range from 0.003 to 0.0100%, by at least one step selected from the group consisting of a) adding iron or nickel nitride into the molten Fe—Ni alloy material to adjust the N content and b) holding the Fe—Ni molten alloy material in a furnace into which nitrogen gas is introduced and kept at an internal pressure of 1 to 300 torrs for 1 to 30 minutes, then cast at an internal pressure of 0.5 torr to adjust the N content;

wherein the etch factor being defined as the ratio of the etching rate in the thickness direction to the etching rate in the side direction when the Fe—Ni alloy material is etched.

2. A method of enhancing the etch factor of a Fe—Ni alloy material for electronic parts, the steps comprising;

providing Fe—Ni alloy material consisting of, all by weight, from 30 to 55% Ni, 0.8 or less Mn, 0.02% or less Al, 0.01% or less C, 0.03% or less Si, 0.005% or less S, 0.005% or less P and 0.0100% or less O, less than 0.003 or more than 0.0100% N, and the balance Fe and unavoidable impurities;

melting said Fe—Ni alloy material to provide a molten Fe—Ni alloy material;

controlling N content in the final Fe—Ni alloy material in the range from 0.0030 to 0.0100% by at least one step selected from the group consisting of a) adding iron or nickel nitride into the molten Fe—Ni alloy material to adjust the N content and b) holding the Fe—Ni molten alloy material in a furnace into which nitrogen gas is introduced and kept at an internal pressure of 1 to 300 torrs for 1 to 30 minutes, then cast at an internal pressure of 0.5 torr to adjust the N content;

wherein etch factor is the ratio of the etching rate in the thickness direction to the etching rate in the side direction when the Fe—Ni alloy material is etched.

* * * * *